US005340058A

United States Patent [19]

Holl et al.

[11] Patent Number: 5,340,058

[45] Date of Patent: Aug. 23, 1994

[54] PROJECTILE WITH COOLED NOSE CONE

[75] Inventors: Rolf Holl, Düsseldorf; Rudolf Rombach, Mönchengladbach; Karl-Heinz Roosmann, Ratingen, all of Fed. Rep. of Germany

[73] Assignee: Rheinmetall GmbH, Dusseldorf, Fed. Rep. of Germany

[21] Appl. No.: 950,603

[22] Filed: Sep. 28, 1992

[30] Foreign Application Priority Data

Sep. 27, 1991 [DE] Fed. Rep. of Germany ..... 4132234

[51] Int. Cl.[5] ..... B64C 1/38

[52] U.S. Cl. ..... 244/117 A; 244/121; 244/158 A; 102/515

[58] Field of Search ..... 244/158 A, 121, 117 A, 244/119, 117 R; 102/501, 515, 516, 518; 89/1.11

[56] References Cited

U.S. PATENT DOCUMENTS

| | | | |
|---|---|---|---|
| 2,482,132 | 9/1949 | Studler et al. | 102/518 |
| 2,724,334 | 11/1955 | Norton et al. | 102/52 |
| 3,001,473 | 9/1961 | Shepheard | 244/158 A |
| 3,200,750 | 8/1965 | Burrows | 102/92.5 |
| 3,682,100 | 8/1972 | Lindberg, Jr. | 102/92.5 |
| 3,745,928 | 7/1973 | Kinnaird et al. | 244/158 A |
| 4,008,348 | 2/1977 | Slemp | 244/117 A |
| 4,016,322 | 4/1977 | Haldeman | 244/158 A |
| 4,041,872 | 8/1977 | McCown et al. | 244/158 A |
| 4,114,369 | 9/1978 | Crowley | 244/158 A |
| 4,173,187 | 11/1979 | Steverding . | |
| 4,428,998 | 1/1984 | Hawkinson | 244/121 |
| 4,431,697 | 2/1984 | Rolinski et al. | 244/117 A |
| 4,686,128 | 8/1987 | Gentilman . | |
| 5,038,561 | 8/1991 | Chase . | |

FOREIGN PATENT DOCUMENTS

| | | |
|---|---|---|
| 1145963 | 3/1963 | Fed. Rep. of Germany . |
| 2856394 | 7/1982 | Fed. Rep. of Germany . |
| 437152 | 10/1935 | United Kingdom . |

OTHER PUBLICATIONS

Hepper, R. H., "Designing for High-Speed Missle Cooling"; *Aero Digest;* Jun., 1956; pp. 48–50, 52.

*Kirk-Othmer Encyclopedia of Chemical Technology;* 1963, pp. 11–13.

*Ullmanns Encyklopadie der technischen Chemie;* vol. 23, p. 520; vol. 2, p. 402; vol. 16, p. 546.

*Primary Examiner*—Galen L. Barefoot

*Attorney, Agent, or Firm*—Spencer, Frank & Schneider

[57] ABSTRACT

A projectile, particularly a kinetic energy projectile, whose nose cone is cooled due to the provision of an ablation layer and a thermal insulation layer (8, 9) on the exterior of the metal hood (4) of the projectile nose cone, and due to a highly thermally conductive medium in the spaces (5, 6) between the hood (4) and the payload (3) particularly a penetrator, of the projectile.

13 Claims, 1 Drawing Sheet

PROJECTILE WITH COOLED NOSE CONE

REFERENCE TO RELATED APPLICATIONS

This application claims the priority of Federal Republic of Germany application Serial No. P 41 32 234.7 filed Sep. 27, 1991, which is incorporated herein by reference.

BACKGROUND OF THE INVENTION

The present invention relates to a projectile provided with a cooled nose cone. More specifically, the present invention relates to a projectile, particularly a kinetic energy projectile, provided with a cooled nose cone, wherein the projectile accommodates a payload, particularly a penetrator, and wherein the nose cone includes a thin-walled metal hood provided on its exterior surface with a thermal insulation layer, and having its interior surface in contact with a heat transfer medium.

Such a projectile, for example an intercontinental missile or the like, is disclosed in U.S. Pat. No. 3,682,100; its nose is provided with a metal hood of molybdenum or steel that is coated on the exterior with ceramic or glass. On the interior, the hood is in contact with lithium hydride which has a low melting point and therefore liquefies when heated and is endothermally dissociated. Lithium present in metal form also becomes liquid and is circulated by means of a pump and is in this way brought into contact with the hydrogen, which was generated by the dissociation, for recombination in the side region of the projectile to be then returned to the nose cone region as lithium hydride. Such a cooling system is very expensive and not suitable for projectiles, such as kinetic energy projectiles, that are used in combat.

U.S. Pat. No. 3,200,750 discloses a projectile nose cone that is provided with a metal hood that is covered with blocks of ceramic material or fiber reinforced plastic. On the exterior, the blocks are provided with brush-like bristles of an endothermally decomposable plastic material such as melamine, phenol resins or nylon. These bristles evaporate before the blocks of ceramic material. Aside from the fact that such a structure is expensive, and although it is possible to thereby reduce the heat intake of the metal hood, no further heat dissipation is provided.

European Application EP-OS 0,359,455, corresponding to U.S. Pat. No. 5,038,561, discloses the provision of a cork layer on the exterior of the metal casing of a rocket engine. This cork layer is covered by an exterior layer of fiber reinforced polymer material while on the interior an insulating layer is disposed between the casing and the solid fuel so as to protect the solid fuel against excessive heating.

SUMMARY OF THE INVENTION

It is an object of the present invention to provide a projectile of the initially described type in which the best possible heat dissipation toward the interior is provided.

The above object is generally achieved according to the present invention by a projectile which comprises: a projectile body having a cooled hollow nose cone, which includes a thin-walled metal hood, a thermal insulation layer provided on the exterior surface of the metal hood, and an outer ablation layer disposed on the thermal insulation layer; a payload disposed in the projectile body and extending into but spaced from the interior of the nose cone; and, a heat transfer medium, which is highly thermally conductive, filling the space between, and being in contact with, the interior surface of the hood and the payload.

The invention generates a heat sink by providing an exterior ablation layer (for example, a sprayed-on polyhalogen hydrocarbon such as polytetrafluoroethylene). The heat sink is produced as a result of evaporation cooling and reduces the amount of heat transferred to the interior.

The subsequent thermal insulation layer (for example, of $Al_2O_3$, $TiO_2$, or the like, applied perhaps in a plasma spraying process) acts as a heat barrier. Its melting point is higher than the highest temperature to be expected in connection with projectiles employed in combat. Particularly if the thermal insulating layer is applied by plasma spraying, its structure is microgranular so that brittle cracks are avoided.

A contact layer of a thermally highly conductive medium, such as a metal paste, particularly a copper paste, is disposed between the thin-walled hood composed, in particular, of an aluminum alloy, and the payload, the penetrator in a kinetic energy projectile, so that residual heat that penetrates the thermal insulation layer, will not heat the hood too much since this heat can be quickly dissipated into the dense mass of the payload, for example the penetrator of a kinetic energy projectile. In this way the payload acts as a heat sink. Its internal heating is insignificant for the flight times involved in connection with combat projectiles, such as kinetic energy projectiles.

In this way, it is easy to realize sufficient durability for the hood of the projectile nose cone, for example a kinetic energy projectile, with respect to aerothermal heating during the presently desired increased projectile velocities and greater ranges.

The invention will be described in greater detail with reference to an embodiment thereof that is illustrated in the drawing figures.

DESCRIPTION OF THE PREFERRED EMBODIMENT

Figure 1:
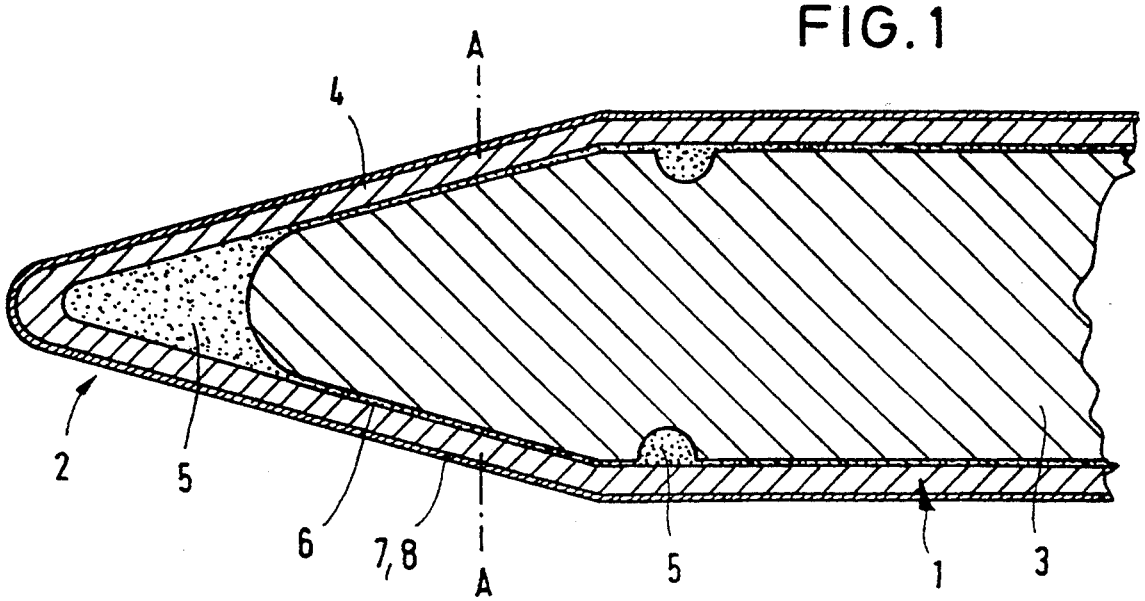
FIG. 1 is a sectional view of the projectile tip of a kinetic energy projectile.
Figure 2:
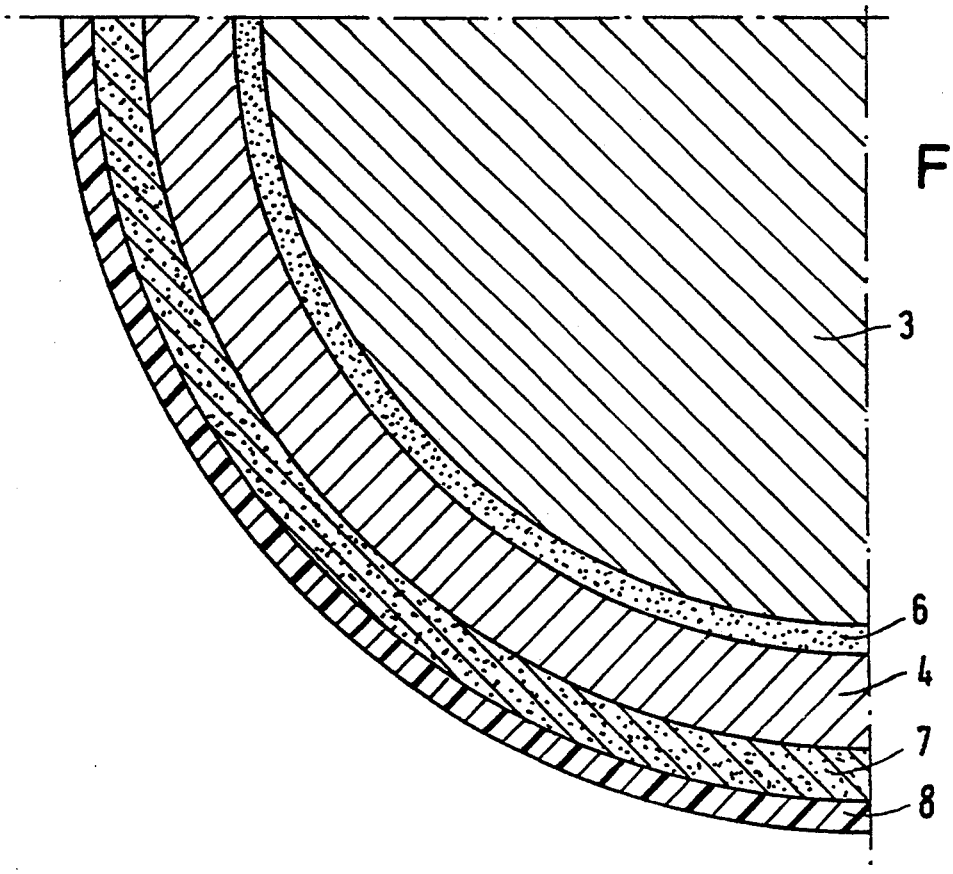
FIG. 2 is a sectional view of one quarter of the kinetic energy projectile seen along line A—A of FIG. 1.

The illustrated kinetic energy projectile essentially includes a cylindrical projectile casing 1 and a conically tapering projectile hollow nose cone 2. In its interior, the projectile accommodates a payload, in particular a penetrator 3. Projectile nose cone 2 includes a metal hood 4, preferably of aluminum, with cavities 5 and gaps 6 being disposed between the nose cone 2 and the penetrator 3. The cavities 5 and gaps 6 are filled with a highly thermally conductive, paste-like, possibly hardenable, heat transfer medium so that heat absorbed by the aluminum hood 4 is transferred to penetrator 3 which acts as a heat sink. Due to its pasty consistency, the heat transfer medium, which preferably is a paste formed of a metal, and particularly copper, can easily be filled into cavities 5 and gaps 6 and produces a good thermally conductive contact between aluminum hood 4 and penetrator 3.

On its exterior surface, aluminum hood 4 is provided with a thermal insulation layer 7, particularly of a ceramic material, e.g. $Al_2O_3$ or $TiO_2$, which preferably is applied by plasma or spraying so that its structure is microgranular. The thermal insulation layer 7 itself is covered on its exterior surface by an ablation layer 8, both the thermal insulation layer 7 and the ablation layer 8 prevent the introduction of heat into the aluminum hood 4 due to aerothermal heating.

The individual layer thicknesses and layer materials can be adapted to one another in such a way that the moment at which the melting temperature of the metal, e.g. aluminum of the aluminum hood 4 is reached, and the associated flying time, are postponed as long as possible.

The material properties of the ablation layer 8 are preferably high specific heat, high evaporation heat and/or high decomposition heat, form stability at evaporation temperatur, stable evaporation without local outbreaks or meltings and low friction. Suitable materials are, for instance, polyhalogen hydrocarbon (such as polytetrafluorethylene), silicone elastomer or silica resin.

An example of the preferred embodiment is a kinetic energy projectile with a penetrator as the payload and a hood composed of an aluminium alloy. The thicknesses of the layers 4,6,7 and 8 are about 2 mm, 0.1 to 0.2 mm, 0.1 to 0.3 mm and 0.1 to 0.3 mm, respectively. For a projectile velocity of 1700 to 1900 m/s, the flight of time before melting of the hood can be extended to about 2 seconds whereas with an unprotected hood this time reduces to about 1 second.

The invention now being fully described, it will be apparent to one of ordinary skill in the art that any changes and modifications can be made thereto without departing from the spirit or scope of the invention as set forth herein.

What is claimed is:

1. A projectile comprising: a projectile body having a cooled hollow nose cone, with said nose cone including a thin-walled metal hood, a thermal insulation layer provided on the exterior surface of said metal hood, and an outer ablation layer disposed on said thermal insulation layer; a payload disposed in said projectile body and extending into but spaced from the interior surface of said nose cone; and, a heat transfer medium, which is a highly thermally conductive metal paste, filling the space between, and being in contact with, said interior surface of said hood and said payload, whereby heat penetrating said thermal insulation layer from said hood is dissipated into said payload.

2. A projectile as defined in claim 1, wherein said projectile is a kinetic energy projectile.

3. A projectile as defined in claim 2, wherein said payload is a penetrator.

4. A projectile as defined in claim 3, wherein said ablation layer is composed of a polyhalogen hydrocarbon.

5. A projectile as defined in claim 4, wherein said polyhalogen hydrocarbon is tetrafluoroethylene.

6. A projectile as defined in claim 4 wherein said metal paste is a copper paste.

7. A projectile as defined in claim 4, wherein said hood is composed of an aluminum alloy.

8. A projectile as defined in claim 7, wherein said thermal insulation layer is a ceramic material.

9. A projectile as defined in claim 8, wherein said thermal insulation layer is a plasma-sprayed layer of said ceramic material.

10. A projectile as defined in claim 1, wherein said ablation layer is composed of a polyhalogen hydrocarbon.

11. A projectile as defined in claim 1, wherein said hood is composed of an aluminum alloy.

12. A projectile as defined in claim 1, wherein said thermal insulation layer is a ceramic material.

13. A projectile as defined in claim 1, wherein said metal paste is a copper paste.

* * * * *